US005445086A

United States Patent [19]

Bolduc

[11] Patent Number: 5,445,086

[45] Date of Patent: Aug. 29, 1995

[54] DEFLECTABLE MAILBOX ASSEMBLY

[76] Inventor: Germain Bolduc, 54 Rabbit Rd., Salisbury, Mass. 01952

[21] Appl. No.: 141,212

[22] Filed: Oct. 26, 1993

[51] Int. Cl.[6] ..... B65D 91/00

[52] U.S. Cl. ..... 232/39; 248/900

[58] Field of Search ..... 232/17, 38, 39; 248/417, 131, 145, 900

[56] References Cited

U.S. PATENT DOCUMENTS

| | | | |
|---|---|---|---|
| 839,607 | 12/1906 | Lanier | 232/39 |
| 1,508,052 | 9/1924 | Hastings | 248/145 |
| 1,631,904 | 6/1927 | Warmack | 248/145 |
| 2,605,073 | 7/1952 | Buck | 232/39 |
| 3,802,656 | 4/1974 | Virblas | 248/417 |
| 4,187,978 | 2/1980 | Dowker | 232/39 |
| 4,955,533 | 9/1990 | Merkel | 232/39 |
| 5,020,720 | 6/1991 | Harpe | 232/39 |

*Primary Examiner*—Flemming Saether

[57] ABSTRACT

A mailbox assembly, includes an upstanding post, installable alongside a roadway, and a mailbox support structure swingably supported on the post, for rotation in a horizontal plane, is described. In the event that a vehicle should leave the roadway and crash into the mailbox, the support structure will swing out of the vehicle path to prevent destruction of the mailbox or support structure. The support structure includes a vertical shaft that is releasably retained in a normal operating position in which the mailbox is accessible to the driver of a vehicle. The support structure can be deflected rotationally by a vehicle crash force, but is resistant to smaller forces, e.g. wind forces or manual forces.

3 Claims, 2 Drawing Sheets

DEFLECTABLE MAILBOX ASSEMBLY

BACKGROUND OF THE PRESENT INVENTION

The present invention relates to a mailbox assembly.

The present invention also relates to a deflectable, or repositionable, mail box assembly.

The present invention, more particularly relates to a deflectable mailbox assembly, installable along the edge of a roadway, whereby a mail delivery person driving a mail truck can deposit mail in the mailbox without leaving the truck. The mailbox is supported, so that if a vehicle should inadvertently be driven off the roadway into the mailbox, the mailbox will be deflected in a horizontal plane away from the roadway, thereby precluding the destructive action that would otherwise take place.

Mailboxes in rural and residential areas are often rigidly supported on upstanding vertical posts located alongside roadways where mail is to be delivered. The driver of a mail truck can deposit mail in the mailbox without leaving the truck. Occasionally the truck will be inadvertently driven into the mailbox, as a result of the driver attempting to get the vehicle to a point within arm's length access to the box. Also, snow plows, buses, automobiles and other vehicles may occasionally be driven off the roadway into roadside mailboxes. Also, snow being pushed by snowplows, may cause damage to conventional maiboxes. In either case, the mailbox and its support structure will often be damaged, usually to a point where it cannot be repaired.

SUMMARY OF THE PRESENT INVENTION

The object of the present invention is to provide a mailbox support assembly.

A further object of the present invention is, more particularly, to provide a deflectable mailbox and support assembly, installable along the edge of a roadway.

The present invention, more particularly, relates to a mailbox and support assembly, wherein the mailbox is mounted on a rotary support structure, such that if the mailbox is struck by a moving vehicle, or plowed snow, it will be deflected in a horizontal plane out of the vehicle movement path, thereby preventing the destruction to the mailbox and support assembly, that might otherwise take place.

In the preferred practice of the present invention, a bumper is carried by the mailbox support structure alongside the box. The bumper acts as a shield for the mailbox, so that any vehicle straying from the roadway will strike the bumper rather than the mailbox. This feature protects the mailbox against severe denting, or deformation, that might otherwise result from direct forcible contact of a moving vehicle against the mailbox surface. The bumper is preferably formed as an upstanding tubular element resistant to damage by impact forces from a moving vehicle.

A major aim of the present invention, is to incorporate a mailbox deflection feature into a mailbox and support assembly, without adding appreciable manufacturing expense into the assembly. The mailbox support means is preferably constructed as a one-piece tubular member, that comprises a vertical tubular shaft, a horizontal tubular portion that forms a platform for the mailbox, and an upstanding tubular portion extending from the horizontal tubular portion to form a protective bumper for the mailbox. The one-piece mailbox support means, has a manufacturing cost that is not appreciably greater than the manufacturing cost for a conventional mailbox support structure.

In summary, and in accordance with the above discussion, the foregoing objectives are achieved in the following embodiments:

1. A deflectable mailbox assembly comprising: a post installable at a point alongside a roadway, said post having a vertical axis;

a mailbox support means, comprising a vertical shaft, means for rotatably mounting said shaft around the shaft axis, and a mailbox platform extending horizontally away from said shaft and said post;

said mailbox platform having a normal position, wherein the mailbox extends between the post and the roadway, whereby the mailbox is accessible to the driver of a mail truck on the roadway; and means for releasably retaining said mailbox platform in its normal position, such that the mailbox can be deflected by a moving vehicle at the edge of the roadway without destroying the mailbox or the mailbox support means.

2. The mailbox assembly, as described in paragraph 1, and further comprising a bumper means extending from said mailbox platform;

said bumper means being located above the plane of the platform to shield the mailbox from a moving vehicle at the edge of the roadway.

3. The mailbox assembly, as described in paragraph 2, wherein said bumper means is further away from said vertical shaft than said mailbox platform.

4. The mailbox assembly, as described in paragraph 2, wherein said platform comprises a horizontal tube, and said bumper means comprises a vertical tube extending upwardly from said horizontal tube.

5. The mailbox assembly, as described in paragraph 4, wherein said vertical shaft extends downwardly from said horizontal tube.

6. The mailbox assembly, as described in paragraph 5, wherein said vertical shaft is a tubular element integral with said horizontal tube.

7. The mailbox assembly, as described in paragraph 1, wherein said shaft mounting means comprises two vertically spaced collars secured to said post, each collar comprising a radial shaft bearing.

8. The mailbox assembly, as described in paragraph 7, wherein said collars are formed of a resilient plastic material, said collars having gripping engagement with said shaft, whereby said collars constitute said releasable retaining means.

9. The mailbox assembly, as described in paragraph 7, wherein each collar comprises a sleeve formed of a rigid resilient plastic material resistant to corrosion forces.

10. The mailbox assembly, as described in paragraph 7, wherein said post has flat side surfaces; and each collar comprising a flat mounting flange secured to a flat surface of the post.

BRIEF DESCRIPTION OF THE DRAWINGS OF THE PRESENT INVENTION

Figure 3:
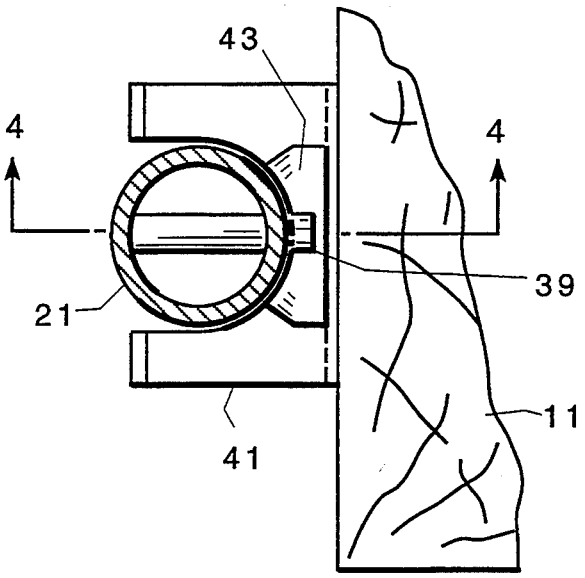
FIG. 3, is an enlarged sectional view, taken along line 3—3 in FIG. 1.
Figure 4:
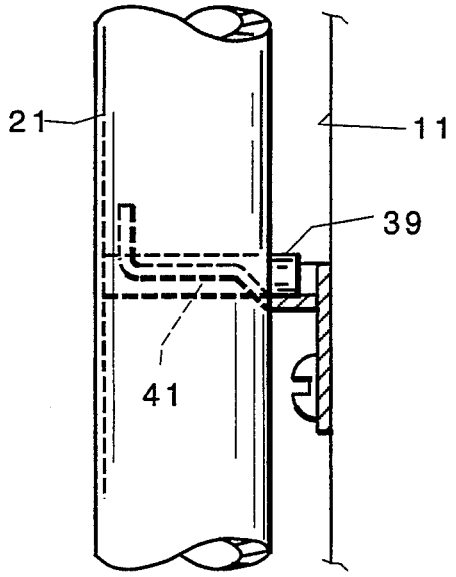

FIG. 4, a sectional view, taken along line 4—4 in FIG. 3.

Figure 5:
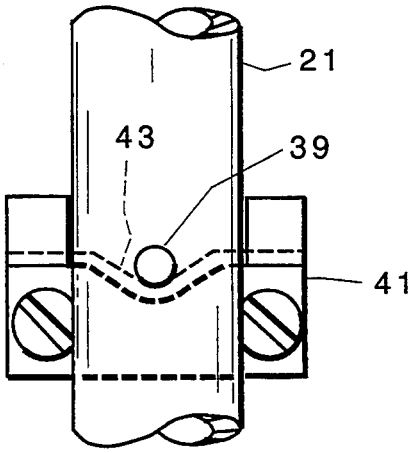

FIG. 5, is a left side view, of the structure shown in FIG. 4.

Figure 6:
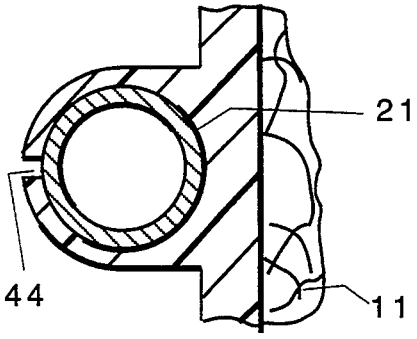

FIG. 6, is a sectional view, taken through a shaft retainer means, that can be used in practice of the present invention.

DESCRIPTION OF A PREFERRED EMBODIMENT OF THE PRESENT INVENTION

Figure 1:
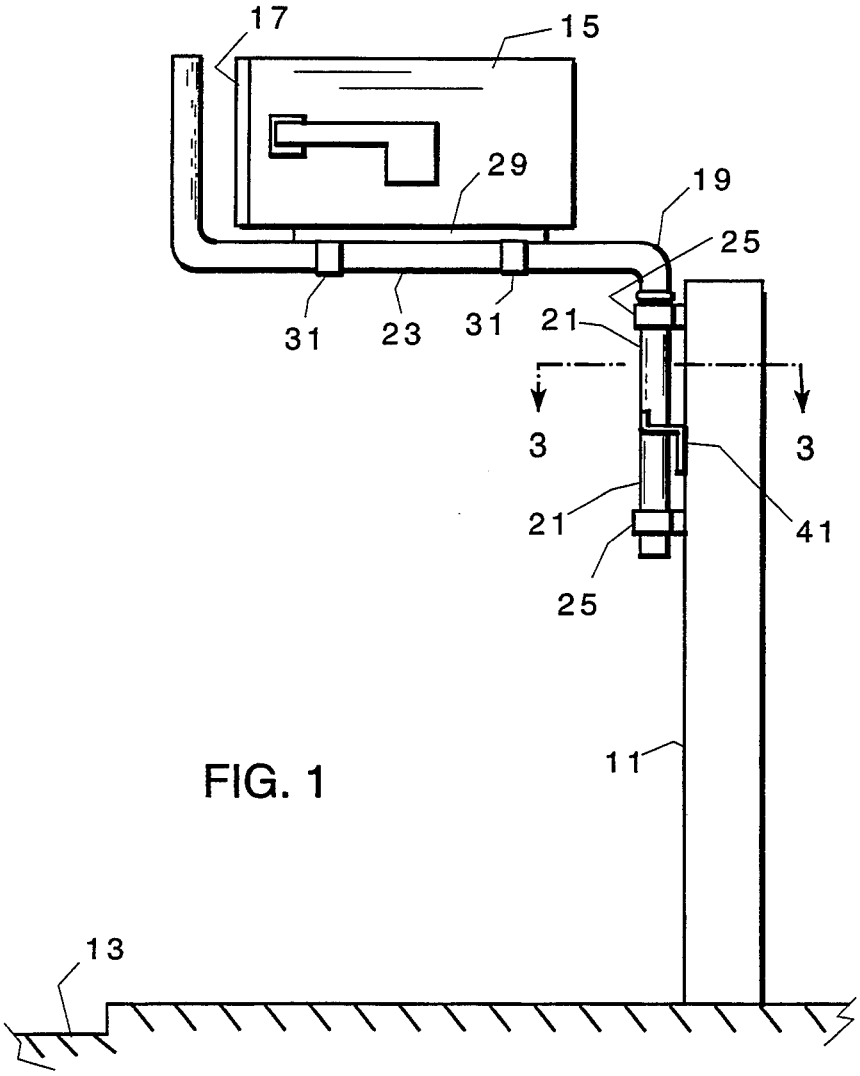
FIG. 1, is a side elevational view, of a deflectable mailbox assembly, embodying the present invention.

FIG. 1, is a side elevational view, of a deflectable mailbox assembly, embodying the present invention.

Figure 2:
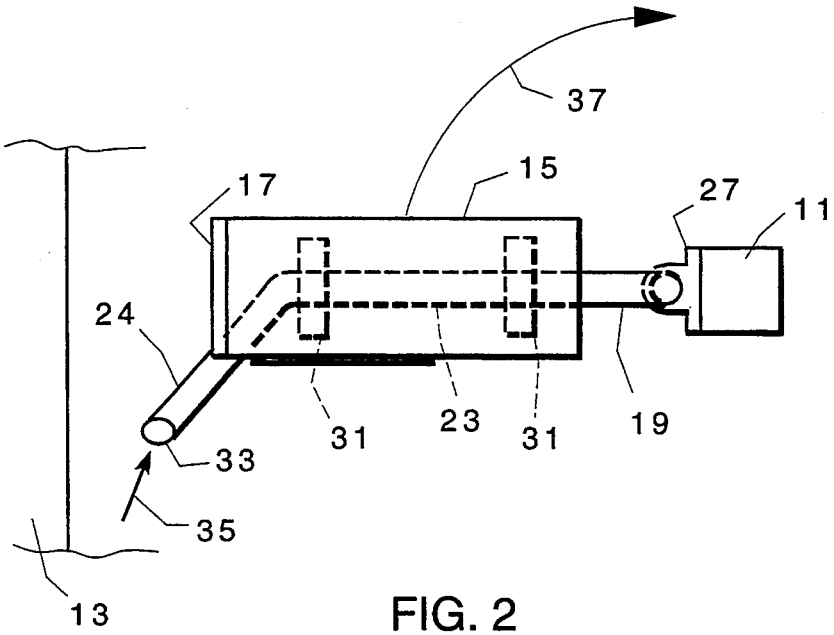
FIG. 2, is a top plan view, of the FIG. 1 mailbox assembly.

FIG. 2, is a top plan view, of the FIG. 1 mailbox assembly.

FIGS. 1 and 2, illustrate a deflectable mailbox assembly, that includes a post 11, sunk into the ground alongside a roadway 13, for supporting a mailbox 15. The mailbox 15, has a hinged closure 17, that can be opened by the driver of a mail truck stopped on roadway 13, so that the driver can reach into mailbox 15, to deposit the mail for later pickup by the person at the mailbox address.

Hinged closure 17, is usually set back from the edge of the roadway 13, so that the truck can move along the roadway without danger of striking the mailbox 15. At the same time, closure 17, is located relatively close to the edge of the roadway, so as to be within arm's reach of the driver of the truck for convenient deposition of mail into the mailbox 15.

The mailbox 15, is supported on a tubular support means 19, that includes a vertical tubular shaft 21, and a horizontal tube 23. Shaft 21, extends downwardly through two vertically spaced collars 25, that are affixed to post 11. Each collar 25, has a mounting flange 27, that seats against the flat side surface of post 11. Screws (not shown) extend through flanges 27, to affix the collars 25, to the post 11.

Each collar 25, is preferably formed of a rigid plastic material resistant to corrosion attack by the weather elements. Shaft 21, can be preferably formed of steel having a rust-resistant surface coating. Each collar 25, encircles shaft 21, to form a radial shaft bearing. The shaft 21, is rotatable in the bearings, for rotational motion around the shaft 21 axis.

The mailbox 15, has a flat bottom wall that is affixed to a flat wooden panel 29, resting on the upper surface of horizontal tube 23. Tube 23, constitutes a mounting platform for mailbox 15. Brackets 31, extend around the undersurface of tube 23, to attach the tube 23, to panel 29; screws (not shown), can be used to attach the brackets 31, to the wooden panel 29. Short lengths of rubber tubing (not shown) can be inserted onto tube 23, to frictionally engage the bracket interior surfaces, to prevent the mailbox 15, from undesired swivel motion around the tube 23 axis.

As shown in FIG. 2, horizontal tube extension 24 angles away from the longitudinal axis of the mailbox 15 at an angle of about 45 degrees to a location outside the mailbox. The extreme end of the tube 24, is turned upwardly to form a vertical tubular bumper 33. As viewed in FIG. 1, bumper 33, is located above the plane of the platform tube 23, so as to be coplanar with box 15. Bumper 33, forms a shield for the mailbox 15, to prevent the mailbox from direct contact with a vehicle that might inadvertently be driven off roadway 13, toward the mailbox 15. Arrow 35, indicates the expected direction that such a vehicle might take.

As previously indicated, vertical shaft 21, can rotate in the bearings, i.e., collars 25. In the event that a vehicle should be driven off the roadway 13, toward the mailbox 15, as indicated by arrow 35, the impact force applied to bumper 33, will cause the mailbox 15, to rotate around the shaft 21 axis, as indicated by arrow 37. The mailbox 15, will be deflected in a clockwise direction, (as viewed in FIG. 2), and away from the roadway 13. In most cases the vehicle will pass through the space normally occupied by the mailbox without damaging the box, as the mailbox will be deflected out of the movement path of the vehicle.

During normal service periods the mailbox should be oriented with its closure 17, near the side edge of the roadway, as depicted in FIG. 1 and 2. Accordingly, shaft 21, should be immovable in collars 25, so that mailbox 15, remains in the FIG. 1 position, unaffected by wind forces, or manual forces, e.g., when the person removes mail from the box, or when the postal worker places mail in the box. The mailbox platform 29, can be releasably retained in its normal position, as shown in FIG. 1 and 2, by using plastic collars 25, as shaft-gripper devices. Thus, with collars 25, tightly encircling shaft 21, the shaft 21, can be rotationally stabilized against disturbing forces having a lesser magnitude than vehicle crash forces.

Collars 25, are preferably formed of nylon, or other plastic material, having a slightly resilient character. By making the inner diameter of the plastic collar 25, minutely slightly less than the outer diameter of shaft 21, it is possible to have the resilient plastic material exert a gripping force on the shaft 21 surface, such that the shaft 21, is immovable under normal load forces (e.g. wind forces and minor manual forces), but is yet rotatable, when a vehicle crash force is applied to bumper 33.

FIG. 6, is a sectional view, taken through a shaft retainer means, that can be used in practice of the present invention.

FIG. 6, shows a plastic collar 25, having a slot 44 therein, for increasing the resilience of the collar 25, and its gripping action on the shaft 21. Under normal load forces the collar sections tightly grip the shaft 21 surface. Under vehicle crash forces the opposed collar sections can spread apart very slightly to enable the shaft 21, to rotate.

FIG. 3, is an enlarged sectional view,taken along line 3—3 in FIG. 1.

FIG. 4, is a sectional view, taken along line 4—4 in FIG. 3.

FIG. 5, is a left side view, of the structure shown in FIG. 4.

FIGS. 3 through 5, show an additional, or alternate, mechanism that can be used to releasably retain the mailbox platform 23, in a normal position, wherein the mailbox closure 17, is accessible to the driver of a mail truck parked on the roadway 13, (as shown in FIG. 1 and 2). The mechanism comprises a pin 39, projecting from tubular shaft 21, and a supporting bracket 41, affixed to post 11. The upper surface of bracket 41, includes a V-shaped depression 43, that forms a seat for pin 39, (when platform 23 is in its normal position). The weight of the mailbox 15, causes shaft 21, to seat in the V-shaped depression, such that wind forces or manual forces (of a reasonably small magnitude) are ineffective to disturb the mailbox 15, position. However, in a vehicle crash situation, the impact force on bumper 33, causes the mailbox 15, to rotate, and shaft 21, rotates to cause pin 39, to ride out of depression 43, onto a flat surface area of bracket 41. The mailbox 15, can be manually returned to its normal position (FIGS. 1 and 2).

The releasably retaining means of FIGS. 3 through 5 can be used to augment the frictional grip action of collars 25, on the shaft 21, surface.

The drawings show one form that the invention can take. Some variations in structure and configuration can be employed. For example, the drawings show shaft 21, platform 23, and bumper 33, as a single tube bent at selected points to provide three tube sections. However, the three tube sections can be formed out of three separate tubes, if such a procedure is deemed necessary for manufacturing reasons. As an additional variant, tubular bumper 33, can be encased (not shown) for cushioning the vehicle impact force and reducing the acceleration forces generated in crash situations. Further, the collars 25, as described herein, may, if preferred, be replaced with other suitable means for releasably mounting the tubular support means 19, to the post 11.

The present invention describes a deflectable mailbox assembly. Features of the present invention are recited in the appended claims. The drawings herein necessarily depict specific structural features and embodiments of the deflectable mailbox assembly, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A deflectable mailbox assembly comprising:

a mailbox having a longitudinal axis with a planer door and side wall;

a post installable at a point along a roadside, said post having a vertical axis;

a mailbox support means, comprising a vertical shaft, means for rotatably mounting said shaft for rotation around the shaft axis, a horizontal tube extending along said longitudinal axis with a mailbox platform for supporting said mailbox;

said mailbox platform having a normal position, wherein the mailbox extends between the post and the roadway, whereby the mailbox is accessible to the driver of a mail truck in the roadway;

means for releasably retaining said mailbox platform in its normal position, such that the mailbox can be deflected by a moving vehicle at the edge of the roadway without destroying the mailbox and mailbox support means;

a bumper means comprising a horizontal tube extension extending from said horizontal tube at an angle of about 45 degrees with respect to said longitudinal axis to an end location outside the plane of said door and said side wall, and a vertical bumper tube extending upward from the end of said horizontal tube extension.

2. The mailbox assembly, as described in claim 1, wherein said vertical shaft extends downwardly from said horizontal tube.

3. The mailbox assembly, as described in claim 2, wherein said vertical shaft is a tubular element integral with said horizontal tube, said horizontal tube extension, and said vertical tube.

* * * * *